US007917068B2

(12) United States Patent
Matsuura

(10) Patent No.: US 7,917,068 B2
(45) Date of Patent: Mar. 29, 2011

(54) DEVELOPING DEVICE AND IMAGE FORMING APPARATUS

(75) Inventor: Yuki Matsuura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 442 days.

(21) Appl. No.: 12/216,748

(22) Filed: Jul. 10, 2008

(65) Prior Publication Data

US 2009/0016782 A1 Jan. 15, 2009

(30) Foreign Application Priority Data

Jul. 11, 2007 (JP) ..... 2007-181620

(51) Int. Cl.
*G03G 15/08* (2006.01)

(52) U.S. Cl. ..... 399/279; 399/53; 399/236

(58) Field of Classification Search ..... 399/53, 399/236, 279, 286
See application file for complete search history.

(56) References Cited

U.S. PATENT DOCUMENTS

| | | | | |
|---|---|---|---|---|
| 6,507,722 | B2 * | 1/2003 | Okamura et al. | 399/286 |
| 6,686,110 | B2 * | 2/2004 | Kadota | 430/108.3 |

FOREIGN PATENT DOCUMENTS

| | | |
|---|---|---|
| JP | 2002-72544 | 3/2002 |
| JP | 2003-207933 | 7/2003 |
| JP | 2003-280330 | 10/2003 |
| JP | 2004-341122 | 12/2004 |
| JP | 2005-227356 | 8/2005 |
| JP | 2006-64773 | 3/2006 |
| JP | 2007-133024 | 5/2007 |

* cited by examiner

*Primary Examiner* — David M Gray
*Assistant Examiner* — Joseph S Wong
(74) *Attorney, Agent, or Firm* — Rabin & Berdo, PC

(57) ABSTRACT

A developing device is disposed facing an image bearing body that bears a latent image. The developing device includes a developer bearing body that bears a developer for developing the latent image. The developer includes mother particles and external additives. A liberation amount T (weight parts) of the external additives liberated from the mother particles with respect to 100 weight parts of the mother particles, a surface roughness Rz (m) of the developer bearing body, and a circumferential speed Vd (mm/s) of the developer bearing body satisfy the following relationships:

$1.326\times10^{-1} \leqq T \leqq 2.142\times10^{-1}$ (weight parts), $7.1\times10^{-6} \leqq Rz \leqq 15.0\times10^{-6}$ (m), $161.5 \leqq Vd \leqq 189.2$ (mm/s), and $4.98\times10^{-6} \leqq (T\times Rz/Vd) \leqq 1.99\times10^{-5}$ (s).

11 Claims, 12 Drawing Sheets

FIG.3

| | EXAMPLE | | | COMPARATIVE EXAMPLE | |
|---|---|---|---|---|---|
| DEVELOPER | A | B | C | D | E |
| CIRCUMFERENTIAL SPEED (m/s) | 40 | 40 | 40 | 30 | 40 |
| ROTATION TIME (s) | 30 | 40 | 40 | 30 | 75 |
| ROTATION CYCLES (times) | 5 | 4 | 3 | 6 | 2 |
| LIBERATION RATIO OF $SiO_2$ | 4.7 | 8.3 | 9.4 | 3.5 | 10.6 |
| LIBERATION RATIO OF $TiO_2$ | 9.5 | 12.2 | 13.9 | 8.0 | 15.1 |
| LIBERATION AMOUNT T ($\times 10^{-1}$) | 1.326 | 1.884 | 2.142 | 1.080 | 2.358 |

FIG.4

| | EXAMPLE | | | | COMPARATIVE EXAMPLE | |
|---|---|---|---|---|---|---|
| DEVELOPING ROLLER | $\alpha$ | $\beta$ | $\gamma$ | $\varepsilon$ | $\zeta$ | $\eta$ |
| GRAIN SIZE ($\mu$m) | 30 | 40 | 40 | 40 | 20 | 40 |
| NUMBER OF POLISHING (times) | 1 | 1 | 2 | 3 | 1 | 3 |
| SURFACE ROUGHNESS ($\mu$m) | 7.1 | 8.3 | 11.1 | 15.0 | 5.0 | 17.2 |

FIG. 5

| | MACHINE M1 | MACHINE M2 |
|---|---|---|
| CIRCUMFERENTIAL SPEED OF DEVELOPING ROLLER (mm/s) | 161.5 | 189.2 |
| OUTER DIAMETER OF DEVELOPING ROLLER (mm) | 18.39 | 17.62 |
| CIRCUMFERENTIAL SPEED OF PHOTOSENSITIVE DRUM (mm/s) | 131.7 | 162.0 |
| OUTER DIAMETER OF PHOTOSENSITIVE DRUM (mm) | 30 | 30 |
| CIRCUMFERENTIAL SPEED OF DEVELOPING ROLLER / CIRCUMFERENTIAL SPEED OF PHOTOSENSITIVE DRUM | 1.226 | 1.168 |

FIG.6

(NIP WIDTH N : 1.0mm, ENVIRONMENT : NN)

| EXAMPLE | 1 | 2 | 3 | 4 | 5 | 6 | 7 | 8 | 9 | 10 | 11 | 12 |
|---|---|---|---|---|---|---|---|---|---|---|---|---|
| TONER | A | B | C | A | B | C | A | B | C | A | B | C |
| DEVELOPING ROLLER | $\alpha$ | $\alpha$ | $\alpha$ | $\alpha$ | $\alpha$ | $\alpha$ | $\beta$ | $\beta$ | $\beta$ | $\beta$ | $\beta$ | $\beta$ |
| MACHINE | M1 | M1 | M1 | M2 | M2 | M2 | M1 | M1 | M1 | M2 | M2 | M2 |
| IMAGE BLURRING | ○ | ○ | ○ | ○ | ○ | ○ | ○ | ○ | ○ | ○ | ○ | ○ |
| LAYER UNDULATION | ○ | ○ | ○ | ○ | ○ | ○ | ○ | ○ | ○ | ○ | ○ | ○ |
| ABRASION OF DEVELOPING ROLLER | ○ | ○ | ○ | ○ | ○ | ○ | ○ | ○ | ○ | ○ | ○ | ○ |
| SMEAR | ○ | ○ | ○ | ○ | ○ | ○ | ○ | ○ | ○ | ○ | ○ | ○ |
| FOG | ○ | ○ | ○ | ○ | ○ | ○ | ○ | ○ | ○ | ○ | ○ | ○ |
| $T \cdot Rz / Vd (\times 10^{-6})$ | 5.83 | 8.28 | 9.43 | 4.98 | 7.07 | 8.04 | 6.81 | 9.68 | 11.0 | 5.82 | 8.26 | 9.40 |

FIG.7

(NIP WIDTH N : 1.0mm, ENVIRONMENT : NN)

| EXAMPLE | 13 | 14 | 15 | 16 | 17 | 18 | 19 | 20 | 21 | 22 | 23 | 24 |
|---|---|---|---|---|---|---|---|---|---|---|---|---|
| TONER | A | B | C | A | B | C | A | B | C | A | B | C |
| DEVELOPING ROLLER | $\gamma$ | $\gamma$ | $\gamma$ | $\gamma$ | $\gamma$ | $\gamma$ | $\varepsilon$ | $\varepsilon$ | $\varepsilon$ | $\varepsilon$ | $\varepsilon$ | $\varepsilon$ |
| MACHINE | M1 | M1 | M1 | M2 | M2 | M2 | M1 | M1 | M1 | M2 | M2 | M2 |
| IMAGE BLURRING | ○ | ○ | ○ | ○ | ○ | ○ | ○ | ○ | ○ | ○ | ○ | ○ |
| LAYER UNDULATION | ○ | ○ | ○ | ○ | ○ | ○ | ○ | ○ | ○ | ○ | ○ | ○ |
| ABRASION OF DEVELOPING ROLLER | ○ | ○ | ○ | ○ | ○ | ○ | ○ | ○ | ○ | ○ | ○ | ○ |
| SMEAR | ○ | ○ | ○ | ○ | ○ | ○ | ○ | ○ | ○ | ○ | ○ | ○ |
| FOG | ○ | ○ | ○ | ○ | ○ | ○ | ○ | ○ | ○ | ○ | ○ | ○ |
| $T \cdot Rz / Vd (\times 10^{-6})$ | 9.11 | 12.9 | 14.7 | 7.78 | 11.1 | 12.6 | 12.3 | 17.5 | 19.9 | 10.5 | 14.9 | 17.0 |

FIG.8

(NIP WIDTH N : 1.0mm, ENVIRONMENT : NN)

| COMPARATIVE EXAMPLE | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| TONER | A | B | C | D | D | D | D | A | B | C | E | E | E | E |
| DEVELOPING ROLLER | ζ | ζ | ζ | ζ | η | ζ | η | η | η | η | ζ | η | ζ | η |
| MACHINE | M1 | M1 | M1 | M1 | M1 | M2 | M2 | M1 | M1 | M1 | M1 | M1 | M2 | M2 |
| IMAGE BLURRING | × | ○ | ○ | ○ | ○ | △ | ○ | ○ | ○ | ○ | ○ | ○ | ○ | ○ |
| LAYER UNDULATION | × | ○ | ○ | × | ○ | ○ | ○ | ○ | ○ | ○ | ○ | ○ | × | ○ |
| ABRASION OF DEVELOPING ROLLER | ○ | ○ | ○ | ○ | ○ | ○ | ○ | ○ | △ | △ | ○ | × | ○ | × |
| SMEAR | ○ | ○ | ○ | ○ | × | ○ | × | × | × | ○ | × | ○ | × | ○ |
| FOG | ○ | △ | △ | ○ | ○ | ○ | ○ | △ | ○ | △ | ○ | △ | △ | △ |
| $T \cdot Rz / Vd (\times 10^{-6})$ | 4.11 | 5.83 | 6.63 | 3.34 | 11.5 | 2.85 | 9.82 | 14.1 | 20.1 | 22.8 | 7.30 | 25.1 | 6.24 | 21.4 |

FIG.10

(NIP WIDTH N : 0.6mm, ENVIRONMENT : HH)

| COMPARATIVE EXAMPLE | 2-1-1 | 2-1-2 | 2-1-3 | 2-1-4 | 2-1-5 | 2-1-6 | 2-1-7 | 2-1-8 | 2-1-9 | 2-1-10 | 2-1-11 | 2-1-12 |
|---|---|---|---|---|---|---|---|---|---|---|---|---|
| TONER | A | B | C | A | B | C | A | B | C | A | B | C |
| DEVELOPING ROLLER | α | α | α | α | α | α | β | β | β | β | β | β |
| MACHINE | M1 | M1 | M1 | M2 | M2 | M2 | M1 | M1 | M1 | M2 | M2 | M2 |
| IMAGE BLURRING | ○ | ○ | ○ | ○ | ○ | ○ | ○ | ○ | ○ | ○ | ○ | ○ |
| LAYER UNDULATION | ○ | ○ | ○ | ○ | ○ | ○ | ○ | ○ | ○ | ○ | ○ | ○ |
| ABRASION OF DEVELOPING ROLLER | ○ | ○ | ○ | ○ | ○ | ○ | ○ | ○ | ○ | ○ | ○ | ○ |
| SMEAR | ○ | ○ | ○ | ○ | ○ | ○ | ○ | ○ | ○ | ○ | ○ | ○ |
| FOG | △ | ○ | ○ | × | ○ | ○ | ○ | ○ | ○ | △ | ○ | ○ |
| $T \cdot Rz / Vd (\times 10^{-6})$ | 5.83 | 8.28 | 9.43 | 4.98 | 7.07 | 8.04 | 6.81 | 9.68 | 11.0 | 5.82 | 8.26 | 9.40 |

FIG.11

(NIP WIDTH N : 0.6mm, ENVIRONMENT : HH)

| COMPARATIVE EXAMPLE | 2-1-13 | 2-1-14 | 2-1-15 | 2-1-16 | 2-1-17 | 2-1-18 | 2-1-19 | 2-1-20 | 2-1-21 | 2-1-22 | 2-1-23 | 2-1-24 |
|---|---|---|---|---|---|---|---|---|---|---|---|---|
| TONER | A | B | C | A | B | C | A | B | C | A | B | C |
| DEVELOPING ROLLER | $\gamma$ | $\gamma$ | $\gamma$ | $\gamma$ | $\gamma$ | $\gamma$ | $\varepsilon$ | $\varepsilon$ | $\varepsilon$ | $\varepsilon$ | $\varepsilon$ | $\varepsilon$ |
| MACHINE | M1 | M1 | M1 | M2 | M2 | M2 | M1 | M1 | M1 | M2 | M2 | M2 |
| IMAGE BLURRING | ○ | ○ | ○ | ○ | ○ | ○ | ○ | ○ | ○ | ○ | ○ | ○ |
| LAYER UNDULATION | ○ | ○ | ○ | ○ | ○ | ○ | ○ | ○ | ○ | ○ | ○ | ○ |
| ABRASION OF DEVELOPING ROLLER | ○ | ○ | ○ | ○ | ○ | ○ | ○ | ○ | ○ | ○ | ○ | ○ |
| SMEAR | ○ | ○ | ○ | ○ | ○ | ○ | ○ | ○ | ○ | ○ | ○ | ○ |
| FOG | ○ | ○ | ○ | ○ | ○ | ○ | ○ | ○ | ○ | ○ | ○ | ○ |
| $T \cdot Rz / Vd$ ($\times 10^{-6}$) | 9.11 | 12.9 | 14.7 | 7.78 | 11.1 | 12.6 | 12.3 | 17.5 | 19.9 | 10.5 | 14.9 | 17.0 |

FIG.12

(NIP WIDTH N : 1.4mm, ENVIRONMENT : LL)

| COMPARATIVE EXAMPLE | 2-2-1 | 2-2-2 | 2-2-3 | 2-2-4 | 2-2-5 | 2-2-6 | 2-2-7 | 2-2-8 | 2-2-9 | 2-2-10 | 2-2-11 | 2-2-12 |
|---|---|---|---|---|---|---|---|---|---|---|---|---|
| TONER | A | B | C | A | B | C | A | B | C | A | B | C |
| DEVELOPING ROLLER | $\alpha$ | $\alpha$ | $\alpha$ | $\alpha$ | $\alpha$ | $\alpha$ | $\beta$ | $\beta$ | $\beta$ | $\beta$ | $\beta$ | $\beta$ |
| MACHINE | M1 | M1 | M1 | M2 | M2 | M2 | M1 | M1 | M1 | M2 | M2 | M2 |
| IMAGE BLURRING | ○ | ○ | ○ | ○ | ○ | ○ | ○ | ○ | ○ | ○ | ○ | ○ |
| LAYER UNDULATION | ○ | ○ | ○ | ○ | ○ | ○ | ○ | ○ | ○ | ○ | ○ | ○ |
| ABRASION OF DEVELOPING ROLLER | ○ | ○ | ○ | ○ | ○ | ○ | ○ | ○ | ○ | ○ | ○ | ○ |
| SMEAR | ○ | ○ | ○ | ○ | ○ | ○ | ○ | ○ | ○ | ○ | ○ | ○ |
| FOG | ○ | ○ | ○ | ○ | ○ | ○ | ○ | ○ | ○ | ○ | ○ | ○ |
| $T \cdot Rz / Vd$ ($\times 10^{-6}$) | 5.83 | 8.28 | 9.43 | 4.98 | 7.07 | 8.04 | 6.81 | 9.68 | 11.0 | 5.82 | 8.26 | 9.40 |

FIG.13

(NIP WIDTH N : 1.4mm, ENVIRONMENT : LL)

| COMPARATIVE EXAMPLE | 2-2-13 | 2-2-14 | 2-2-15 | 2-2-16 | 2-2-17 | 2-2-18 | 2-2-19 | 2-2-20 | 2-2-21 | 2-2-22 | 2-2-23 | 2-2-24 |
|---|---|---|---|---|---|---|---|---|---|---|---|---|
| TONER | A | B | C | A | B | C | A | B | C | A | B | C |
| DEVELOPING ROLLER | $\gamma$ | $\gamma$ | $\gamma$ | $\gamma$ | $\gamma$ | $\gamma$ | $\varepsilon$ | $\varepsilon$ | $\varepsilon$ | $\varepsilon$ | $\varepsilon$ | $\varepsilon$ |
| MACHINE | M1 | M1 | M1 | M2 | M2 | M2 | M1 | M1 | M1 | M2 | M2 | M2 |
| IMAGE BLURRING | ○ | ○ | ○ | ○ | ○ | ○ | ○ | ○ | ○ | ○ | ○ | ○ |
| LAYER UNDULATION | ○ | ○ | ○ | ○ | ○ | ○ | ○ | ○ | ○ | ○ | ○ | ○ |
| ABRASION OF DEVELOPING ROLLER | ○ | ○ | ○ | ○ | ○ | ○ | ○ | ○ | ○ | ○ | ○ | ○ |
| SMEAR | ○ | ○ | ○ | ○ | ○ | ○ | × | × | ○ | × | ○ | ○ |
| FOG | ○ | ○ | ○ | ○ | ○ | ○ | ○ | ○ | ○ | ○ | ○ | ○ |
| $T \cdot Rz / Vd (\times 10^{-6})$ | 9.11 | 12.9 | 14.7 | 7.78 | 11.1 | 12.6 | 12.3 | 17.5 | 19.9 | 10.5 | 14.9 | 17.0 |

DEVELOPING DEVICE AND IMAGE FORMING APPARATUS

BACKGROUND OF THE INVENTION

This invention relates to a developing device using toner as developer, and an image forming apparatus provided with such a developing device.

There is known an image forming apparatus including an image bearing body having a surface on which a latent image is formed, a developing member disposed in contact with the image bearing body which causes the toner to adhere to the latent image, a toner supply member disposed in contact with the developing member, and a toner layer forming member that forms a thin toner layer on the surface of the developing member (see, Japanese Laid-open Patent Publication No. 2004-341122). Further, in order to enhance image quality, it is proposed to control saturated apparent density of the toner by adjusting the kind and amount of cleaning aid added to the toner.

However, in the conventional image forming apparatus, deterioration of image quality may occur in the case where printing is continuously performed. Therefore, a demand for lengthening the lifetime of the image forming apparatus may not be satisfied.

SUMMARY OF THE INVENTION

The present invention is intended to solve the above described problems, and an object of the present invention is to provide a developing device and an image forming apparatus capable of preventing deterioration of image quality even when continuous printing is performed.

The present invention provides a developing device disposed facing an image bearing body that bears a latent image. The developing device includes a developer bearing body that bears a developer for developing the latent image. The developer includes mother particles and external additives. A liberation amount T (weight parts) of the external additives liberated from the mother particles with respect to 100 weight parts of the mother particles, a surface roughness Rz (m) of the developer bearing body, and a circumferential speed Vd (mm/s) of the developer bearing body satisfy the following relationships:

$$1.326\times10^{-1}\leqq T\leqq 2.142\times10^{-1} \text{ (weight parts)},$$

$$7.1\times10^{-6}\leqq Rz\leqq 15.0\times10^{-6} \text{ (m)},$$

$$161.5\leqq \mathrm{Vd}\leqq 189.2 \text{ (mm/s), and}$$

$$4.98\times10^{-6}\leqq (T\times Rz/Vd)\leqq 1.99\times10^{-5} \text{ (s)}.$$

With such an arrangement, it becomes possible to prevent the deterioration of image quality even when the continuous printing is performed. Therefore, a demand for lengthening the lifetime of the image forming apparatus can be satisfied.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 3 is a table showing manufacturing conditions and properties of toners of Examples and Comparative Examples;

FIG. 4 is a table showing manufacturing conditions and properties of developing rollers of Examples and Comparative Examples;

FIG. 5 is a table showing circumferential speeds of developing rollers and photosensitive drums of a machine M1 and a machine M2 used in continuous printing tests on Examples and Comparative examples;

FIG. 6 is a table showing results of continuous printing tests on Examples 1 through 12;

FIG. 7 is a table showing results of continuous printing tests on Examples 13 through 24;

FIG. 8 is a table showing results of continuous printing tests on Comparative Examples 1 through 14;

FIG. 10 is a table showing results of continuous printing tests on Comparative Examples 2-1-1 through 2-1-12 according to the second embodiment of the present invention;

FIG. 11 is a table showing results of continuous printing tests on Comparative Examples 2-1-13 through 2-1-24 according to the second embodiment of the present invention;

FIG. 12 is a table showing results of continuous printing tests on Comparative Examples 2-2-1 through 2-2-12 according to the second embodiment of the present invention, and FIG. 13 is a table showing results of continuous printing tests on Comparative Examples 2-2-13 through 2-2-24 according to the second embodiment of the present invention.

DETAILED DESCRIPTION OF THE PREFERRED EMBODIMENT

Figure 1:
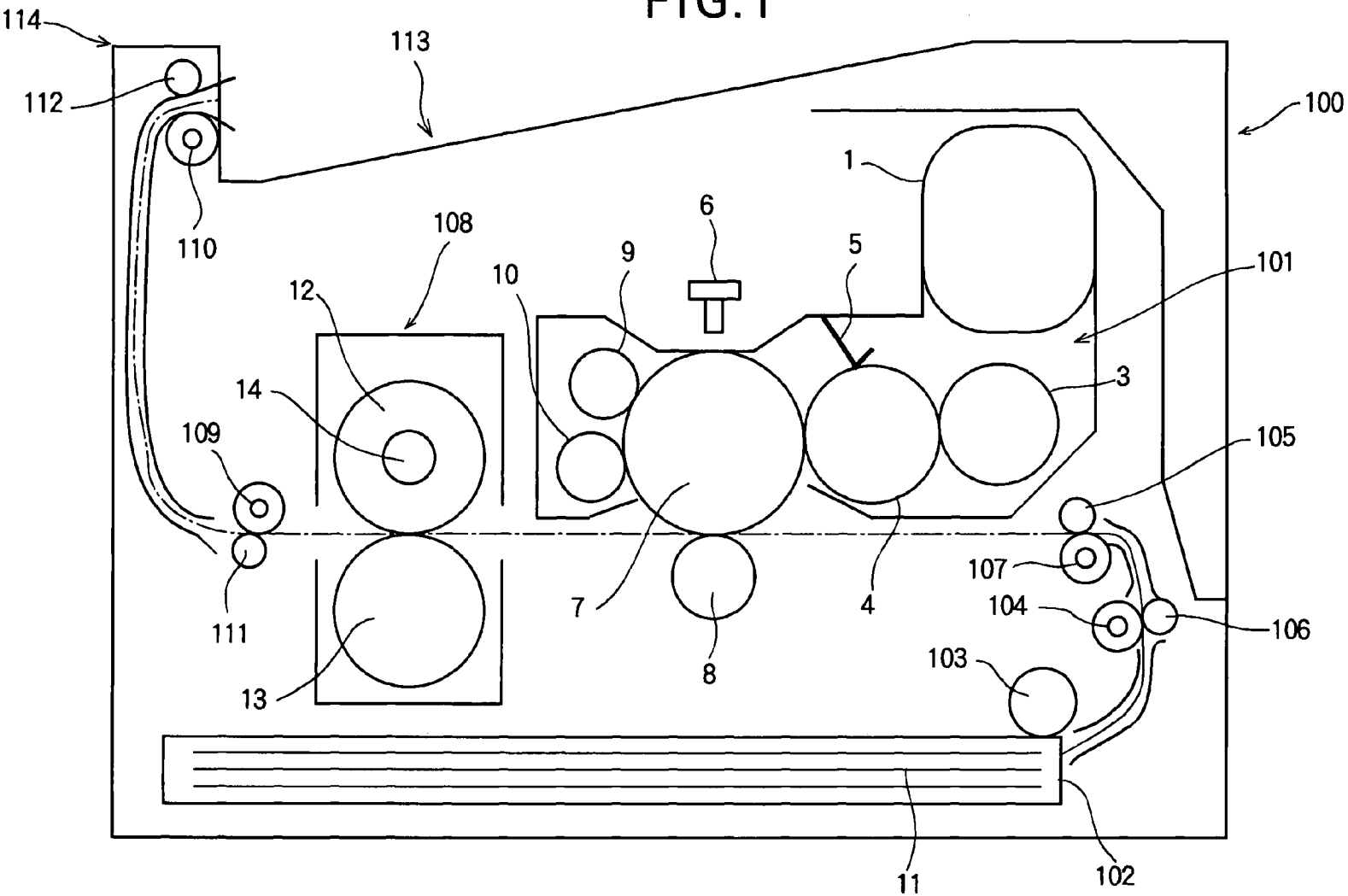
FIG. 1 is a schematic view showing a configuration of an image forming apparatus including a developing device according to the first embodiment of the present invention.

FIG. 1 is a schematic view showing an image forming apparatus 100 according to embodiment of the present invention. Here, the image forming apparatus 100 is in the form of a printer. A developing device 101 according to the embodiment of the present invention is detachably mounted to the image forming apparatus 100. The developing device 101 is configured to form, for example, a black image.

A sheet cassette 102 is mounted to a lower part of the image forming apparatus 100. The sheet cassette 102 stores a stack of recording media 11 such as papers. A hopping roller 103 is disposed on the upper side of the sheet cassette 102. The hopping roller 103 individually feeds the recording medium 11 from the sheet cassette 102. A conveying roller 106 and a pinch roller 104 are disposed on the downstream side of the hopping roller 103. The conveying roller 106 and the pinch roller 104 sandwich the recording medium 11 and convey the recording medium 11. A registration roller 107 and a pinch roller 105 are disposed on further downstream side. The registration roller 107 and the pinch roller 105 correct the skew of the recording medium 11 and convey the recording medium 11 to the developing device 101.

The hopping roller 103, the conveying roller 106, the registration roller 107 are driven (to rotate) by a not shown driving source via not shown gears.

A transfer roller 8 is disposed facing a photosensitive drum 7 of the developing device 101. The transfer roller 8 is composed of an electrically conductive rubber or the like. The transfer roller 8 is applied with a voltage for causing a difference between surface electric potentials of the photosensitive drum 7 and the transfer roller 8 so that the toner image is transferred from the photosensitive drum 7 to the recording medium 11.

A fixing unit 108 includes a heat roller 12 and a backup roller 13 as described later. The heat roller 12 has an internal heat source 14 such as a halogen lamp. The heat roller 12 and the backup roller 13 apply heat and pressure to the toner image on the recording medium 11, to thereby fix the toner image to the recording medium 11. An eject roller 109 and a pinch roller 111 are disposed on the downstream side of the fixing unit 108. The eject roller 109 and the pinch roller 111 sandwich the recording medium 11 and conveys the recording medium 11. An eject roller 110 and a pinch roller 112 are disposed on further downstream side. The eject roller 110 and the pinch roller 112 sandwich the recording medium 11 and conveys the recording medium 11 to a stacker portion 113 provided on an upper cover of the image forming apparatus 100. The fixing unit 108, the eject rollers 109 and 110 are driven by a not shown driving source via gears.

Figure 2:
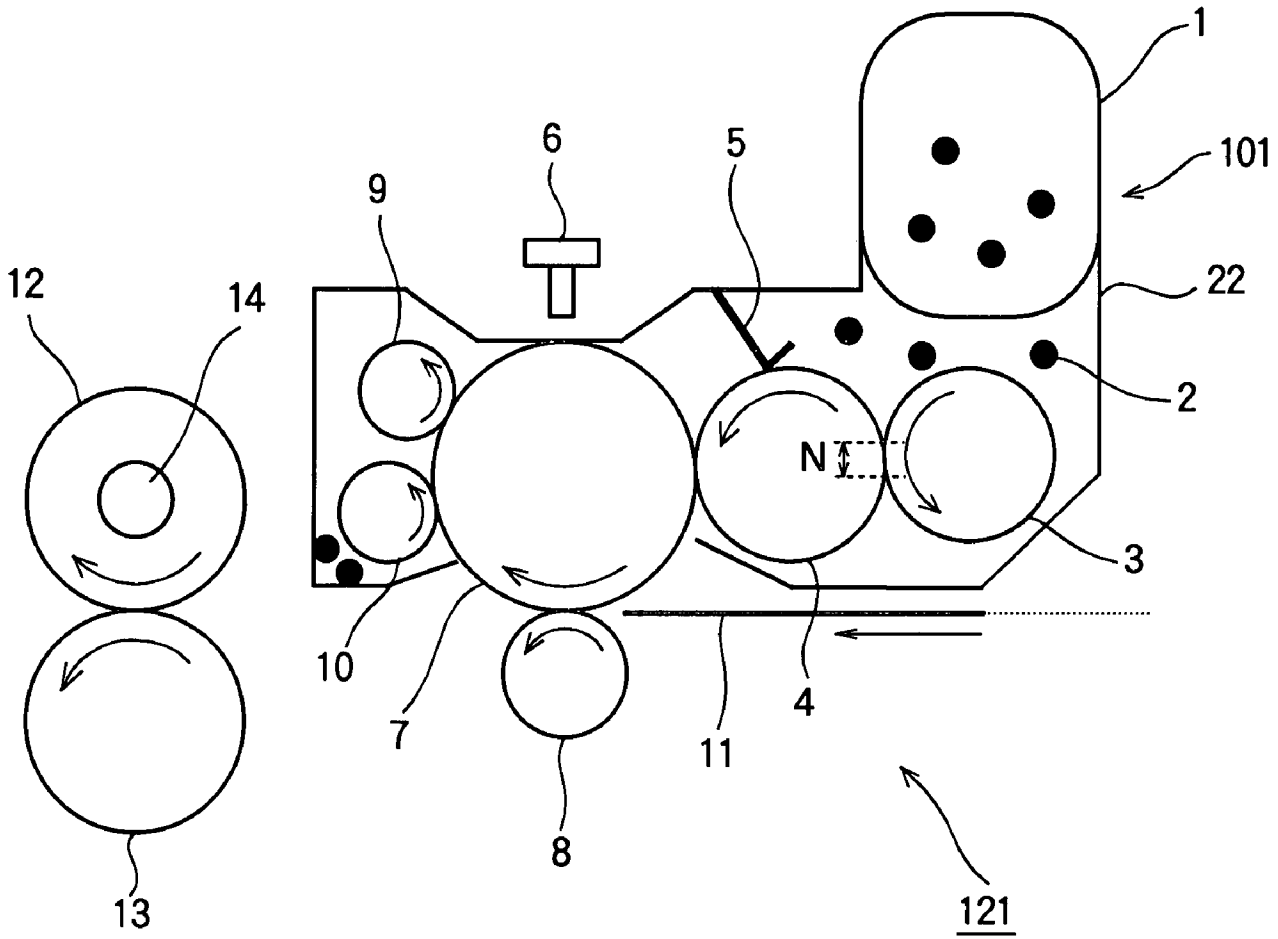
FIG. 2 is a schematic view showing the developing device according to the first embodiment of the present invention.

FIG. 2 is a schematic view showing a configuration of an image forming portion 121 (including the developing device 101) according to the embodiment of the present invention.

The image forming portion 121 is configured to perform developing and transferring of the image using electrophotography. The image forming portion 121 includes a photosensitive drum 7 as a latent image bearing body that bears a latent image on the surface thereof, a charge roller 9 that uniformly charges the surface of the photosensitive drum 7, and an LED head 6 (i.e., an exposing unit) that exposes the surface of the photosensitive drum 7 to form a latent image thereon. The image forming portion 121 further includes a developing roller 4 as developer bearing body disposed facing the photosensitive drum 7 to develop the latent image (i.e., to form a toner image on the surface of the photosensitive drum 7), a sponge roller 3 as a developer supplying member that supplies toner 2 to the developing roller 4, and a developing blade 5 as a developer layer forming member that forms a thin toner layer on the surface of the developing roller 4 before the toner layer faces the photosensitive drum 7. The image forming unit 121 further includes the transfer roller 8 that transfers the toner image from the surface of the photosensitive drum 7 to the recording medium 11, and a cleaning roller 10 that scrapes off the residual toner remaining on the surface of the photosensitive drum 7.

The sponge roller 3, the developing roller 4, the developing blade 5, the photosensitive drum 7, the charge roller 9 and the cleaning roller 10 are housed in a housing 22, so as to constitute the developing device 101.

The toner cartridge 1 supplies the toner 2 to the inside of the developing device 101. The toner 2 includes mother particles and external additives as described later. The external additives contain, for example, hydrophobic silica fine powder and metal oxide fine powder.

The photosensitive drum 7 contacts the developing roller 4, the transfer roller 8, the charge roller 9 and the cleaning roller 10. The developing roller 4 contacts the sponge roller 3 and the developing blade 5.

In the developing device 101 of the first embodiment, the outer diameter of the photosensitive drum 7 is 30 mm, the outer diameter of the developing roller 4 is 18.39 mm, the outer diameter of the sponge roller 3 is 14.6 mm, and a nip width N between the developing roller 4 and the sponge roller 3 shown in FIG. 2 (i.e., a width over which the developing roller 4 and the sponge roller 3 contact each other) is 1.00 mm.

The developing and transferring process is performed by the image forming portion 121, and the fixing process is performed by the fixing unit 108 disposed on the downstream side of the image forming portion 121 in the conveying direction of the recording medium 11.

The heat roller 12 is a tubular roller, and is made of an aluminum tube on which PFA (tetra-fluoro-ethylene perfluoro-alkyl-vinyl-ether copolymer) or PTFE (poly tetra fluoro ethylene) is coated. The heat roller 12 has a halogen lamp 14 as an internal heat source. The backup roller 13 is a resilient roller, and is pressed against the heat roller 12.

Although not shown in FIG. 2, gears are fixed to the photosensitive drum 7 and the respective rollers (other than the backup roller 13) by means of press-fitting or other method. To be more specific, a gear fixed to the photosensitive drum 7 is referred to as a drum gear. A gear fixed to the developing roller 4 is referred to as a developing roller gear. A gear fixed to the sponge roller 3 is referred to as a sponge roller gear. A gear fixed to the charge roller 9 is referred to as a charge roller gear. A gear fixed to the cleaning roller 10 is referred to as a cleaning roller gear. A gear fixed to the transfer roller 8 is referred to as a transfer roller gear. A gear provided between the developing roller gear and the sponge roller gear is referred to an idle gear. A gear fixed to the heat roller 12 is referred to as a heat roller gear.

The respective rollers and LED head 6 (used in the developing process and the transferring process) and the halogen lamp 14 (used in the fixing process) are applied with electricity by a not shown power source provided in the main body of the image forming apparatus, to be more specific, a high voltage power source (which is generally used in an electrophotographic printer) controlled by a not shown control unit.

First Embodiment

In the first embodiment, the above configured image forming apparatus is used.

The amount (weight parts) of the external additives liberated from the mother particles (with respect to 100 weight parts of mother particles) is referred to as a liberation amount T of the external additives.

The surface roughness of the developing roller 4 is expressed as Rz (μm).

The circumferential speed of the developing roller 4 is expressed as Vd (mm/s).

Respective parameters are set so as to satisfy the following inequality (1):

$$4.98\times10^{-6} \leqq T\cdot Rz/Vd \leqq 1.99\times10^{-5} \quad (1)$$

For example, the liberation amount T of the external additives, the surface roughness Rz of the developing roller 4 and the circumferential speed of the developing roller 4 are in the following ranges:

$$1.326\times10^{-1} \leqq T \leqq 2.142\times10^{-1}$$

$$7.10\times10^{-6} \leqq Rz \leqq 1.50\times10^{-5}$$

$$161.5 \leqq Vd \leqq 189.2$$

When the external additives contain a plurality of compositions (the number of which is expressed as m), the liberation amount T (weight parts) of the external additives liberated from 100 weight parts of the mother particles is expressed by the following equation (2):

$$T = \sum_{i=1}^{m} Pi \times Yi / 100 \quad (2)$$

where Pi (weight parts) is an amount (referred to as an adding amount) of i-th external additives (i=1 to m) added to 100 weight parts of the mother particles. Yi is a liberation ratio which is a ratio of an amount of i-th external additives (liberated from the mother particles) to the total amount of i-th external additives.

In this embodiment, the external additives contain hydrophobic silica fine particles and metal oxide fine particles as described above. In this case, the adding amount of the hydrophobic silica fine particles (with respect to 100 weight parts of the mother particles) is expressed as Ps (weight parts), and the liberation ratio of the hydrophobic silica fine particles is Ys (%). Similarly, the adding amount of the metal oxide fine particles (with respect to 100 weight parts of the mother particles) is expressed as Pt (weight parts), and the liberation ratio of the metal oxide fine particles is Yt (%).

From the above described equation (2), the following equation (3) is obtained:

$$T=(Ps \times Ys/100)+(Pt \times Yt/100) \quad (3)$$

In order to satisfy the equation (3), the values of Ps, Ys, Pt and Yt are set, for example, as follows:

Ps=0.8 (weight parts), $$4.7(\%) \leqq Ys \leqq 9.4(\%),$$

Pt=1.0 (weight parts), and $$9.5(\%) \leqq Yt \leqq 13.9(\%).$$

In this regard, the liberation ratios of respective components of the external additives are measured using "Particle Analyzer DP-1000" (manufactured by Horiba Ltd).

The measuring conditions are as follows:

The detected number of carbon atoms (C) for one measurement is in a range from 500 to 1000.

The noise cutting level is 1.5 V or less.

The sorting time is 20 digits.

Helium gas containing oxygen gas (0.1%) is used.

The analyzing wavelengths are as follows:

Carbon atoms (C): 247.86 nm

Silicon atoms (Si): 288.16 nm

Titanium atoms (Ti): 334.90 nm

The liberation ratios of respective atoms are determined by:

$$C1/(C1+C2) \times 100(\%),$$

where C1 is a counted number of synchronous light emission atoms that emit light at the same time as the carbon atoms, and C2 is a counted number of non-synchronous light emission atoms that do not emit light at the same time as the carbon atoms. Therefore, the unit (%) of the liberation ratio is a percent in number of atoms (elements).

In the first embodiment, the toner is manufactured as follows:

2 weight parts of low-molecular weight polyethylene as offset preventing agent, 1 weight part of charge controlling agent "Aizen Spilon Black TRH" (manufactured by Hodogaya Chemical Company), 6 weight parts of carbon black "Printex L" (manufactured by Degussa AG) and 1 weight part of 2,2'-azobisisobutyronitrile are added to 77.5 weight parts of styrene and 22.5 weight parts of acrylic acid-n-butyl. These are put in an attritor "MA-01SC" (manufactured by Mitsui Miike Kakouki Co., Ltd.), and dispersed for 10 hours at the temperature of 15° C., so that a polymerizable composition is obtained. Further, 180 weight parts of ethanol in which 8 weight parts of poly-acryl and 0.35 weight parts of divinyl-benzene are solved is prepared, and added with 600 weight parts of distilled water, so that a dispersion medium is obtained. The above described polymerizable composition is added to the dispersion medium, and is dispersed at the rotation speed of 8000 rpm and at the temperature of 15° C. for 10 minutes using "TK Homo Mixer" manufactured by Tokusyukika-Kogyo Co., Ltd. Then, the resultant dispersion solution is put into a separable flask of 1 litter, and is agitated at the rotation speed of 100 rpm in nitrogen atmosphere at the temperature of 85° C. for 12 hours so as to cause reaction. A dispersion solute obtained by polymerization reaction of the polymerizable composition at this stage is referred to as intermediate particles.

Next, an aqueous emulsion A is prepared by mixing in the aqueous suspension of the intermediate particles with the following materials: 9.25 weight parts of methyl methacrylate, 0.75 weight parts of acrylic acid-n-butyl, 5 weight parts of 2,2'-azobisisobutylonitrile, 0.1 weight parts of sodium lauryl sulfate and 80 weight parts of water, using ultrasonic transmitter "US-150" (manufactured by Nippon-Seiki Co., Ltd.). 9 weight parts of this aqueous emulsion A is dripped so that the intermediate particles are swollen. Immediately after the dripping, an observation is performed using microscopes, and it is confirmed that the emulsion droplets disappear, i.e., it is confirmed that the swelling is completed in a very short time period. The resultant material is agitated under the nitrogen atmosphere at the temperature of 85° C. for 10 hours so as to cause a polymerization reaction of the second stage. After cooling of the material, the dispersion medium is solved in aqueous hydrochloric solution of 0.5N, filtrated, rinsed in water, and air-dried. Further, the resultant material is dried at the temperature of 40° C. for 10 hours under a reduced pressure (10 mmHg), and classified using an air stream classifier. As a result, a toner (having no external additives) whose mean volume diameter is 7.0 μm is obtained. The mean volume diameter of the toner (i.e., mother particles) is measured using a cell counting and sizing instrument "Coulter Counter Multisizer 3" (manufactured by Beckman Coulter Inc.) by setting the count of the instrument to 30000 and setting the aperture diameter to 100 μm. Thereafter, 0.8 weight parts of silica (product name: "RX200" manufactured by Degussa AG) being hydrophobized and having particle diameter of 12 nm, and titanium oxide (product name: "TAF-110P" manufactured by Fuji Titanium Industry Co., Ltd.) being subject to silane coupling treatment and having particle diameter of 50 nm are added to 100 weight parts of the above described mother particles, and mixed by a mixing machine "Henschel mixer" (manufactured by Mitsui Miike Kakouki Co., Ltd.) at the temperature of 25° C. and the humidity of 50 RH %.

By changing the conditions in the mixing process, toners A, B, C, D and E are obtained as shown in FIG. 3.

To be more specific, the toner A is obtained by putting the mother particles (i.e., toner particles with no external particles), silica ($SiO_2$) and titanium oxide ($TiO_2$: titania) into a mixing vessel of the Henschel mixer. Then, the circumferential speed of the Henschel mixer is increased from 0 to 40 m/s in 5 seconds, and is kept at 40 m/s for 30 seconds. Thereafter, the circumferential speed of the Henschel mixer is decreased to 0 in 5 seconds, and is kept at 0 for 30 seconds. This cycle is performed 5 times (i.e., the total time in which the circumferential speed is 40 m/s is 150 seconds). The circumferential speed (m/s), the rotation time period (s) and the number of cycles (times) of the Henschel mixer are controlled so as to obtain a predetermined liberation ratio. The liberation ratio of the toner A is measured by the particle analyzer under the above described conditions. As a result of measurement, the liberation ratio Ys of silica is 4.7%, and the liberation ratio Yt of titanium oxide is 9.5%. Therefore, based on the above described equation (3), the liberation amount T of external additives (with respect to 100 weight parts of mother particles) is $1.326\times10^{-1}$ weight parts.

In this regard, the liberation amount of silica and the liberation amount of titanium oxide (with respect to 100 weight parts of mother particles) are determined respectively by Ps×Ys/100 and Pt×Yt/100.

Therefore, for the toner A (Ps=0.8 weight parts and Pt=1.0 weight parts), the liberation amount of silica is $0.376\times10^{-1}$, and the liberation amount of titanium oxide is $0.950\times10^{-1}$.

The toner B is obtained by putting the mother particles, silica ($SiO_2$) and titanium oxide ($TiO_2$: titania) into the mixing vessel of the Henschel mixer. Then, the circumferential speed of the Henschel mixer is increased from 0 to 40 m/s in 5 seconds, and is kept at 40 m/s for 40 seconds. Thereafter, the circumferential speed of the Henschel mixer is decreased to 0 in 5 seconds, and is kept at 0 for 30 seconds. This cycle is performed 4 times (i.e., the total time in which the circumferential speed is 40 m/s is 160 seconds). As a result of measurement using the particle analyzer, the liberation ratio Ys of silica is 8.3%, and the liberation ratio Yt of titanium oxide is 12.2%. Therefore, based on the above described equation (3), the liberation amount T of external additives is $1.884\times10^{-1}$ weight parts.

For the toner B, the liberation amount of silica is $0.664\times10^{-1}$, and the liberation amount of titanium oxide is $1.220\times10^{-1}$.

The toner C is obtained by putting the mother particles, silica ($SiO_2$) and titanium oxide ($TiO_2$: titania) into the mixing vessel of the Henschel mixer. Then, the circumferential speed of the Henschel mixer is increased from 0 to 40 m/s in 5 seconds, and is kept at 40 m/s for 40 seconds. Thereafter, the circumferential speed of the Henschel mixer is decreased to 0 in 5 seconds, and is kept at 0 for 30 seconds. This cycle is performed 3 times (i.e., the total time in which the circumferential speed is 40 m/s is 120 seconds). As a result of measurement using the particle analyzer, the liberation ratio Ys of silica is 9.4%, and the liberation ratio Yt of titanium oxide is 13.9%. Therefore, based on the above described equation (3), the liberation amount T of external additives is $2.142\times10^{-1}$ weight parts.

For the toner C, the liberation amount of silica is $0.752\times10^{-1}$, and the liberation amount of titanium oxide is $1.390\times10^{-1}$.

The toner D is obtained by putting the mother particles, silica ($SiO_2$) and titanium oxide ($TiO_2$: titania) into the mixing vessel of the Henschel mixer. Then, the circumferential speed of the Henschel mixer is increased from 0 to 30 m/s in 5 seconds, and is kept at 30 m/s for 30 seconds. Thereafter, the circumferential speed of the Henschel mixer is decreased to 0 in 5 seconds, and is kept at 0 for 30 seconds. This cycle is performed 6 times (i.e., the total time in which the circumferential speed is 30 m/s is 180 seconds). As a result of measurement using the particle analyzer, the liberation ratio Ys of silica is 3.5%, and the liberation ratio Yt of titanium oxide is 8.0%. Therefore, based on the above described equation (3), the liberation amount T of external additives is $1.080\times10^{-1}$ weight parts.

For the toner D, the liberation amount of silica is $0.280\times10^{-1}$, and the liberation amount of titanium oxide is $0.800\times10^{-1}$.

The toner E is obtained by putting the mother particles, silica ($SiO_2$) and titanium oxide ($TiO_2$: titania) into the mixing vessel of the Henschel mixer. Then, the circumferential speed of the Henschel mixer is increased from 0 to 40 m/s in 5 seconds, and is kept at 40 m/s for 75 seconds. Thereafter, the circumferential speed of the Henschel mixer is decreased to 0 in 5 seconds, and is kept at 0 for 30 seconds. This cycle is performed 2 times (i.e., the total time in which the circumferential speed is 40 m/s is 150 seconds). As a result of measurement using the particle analyzer, the liberation ratio Ys of silica is 10.6%, and the liberation ratio Yt of titanium oxide is 15.1%. Therefore, based on the above described equation (3), the liberation amount T of external additives is $2.358\times10^{-1}$ weight parts.

For the toner E, the liberation amount of silica is $0.848\times10^{-1}$, and the liberation amount of titanium oxide is $1.510\times10^{-1}$.

The developing roller 4 is manufactured as follows:

0.05 weight parts of lithium perchlorate is added to 100 weight parts of polyester polyol "Kurapol P-2010" (manufactured by Kuraray Co., Ltd.), and is dispersed to be solved. The temperature of the solution is adjusted to 100° C. Then, 20 weight parts of "Coronate HX" (manufactured by Nippon Polyurethane Industry Co., Ltd.) and 20 weight parts of alcohol-modified silicone oil ("SF8427" manufactured by Dow Corning Toray Co., Ltd.) are added to the solution and are dispersed, so as to obtain a mixture. The mixture is injected into a mold preliminarily heated to 120° C. and in which a shaft (having a diameter of 8 mm and a length of 270 mm) is preliminarily disposed. Then, the mixture is heated at 120° C. for 60 minutes, so that a conductive polyurethane resilient layer is formed on the surface of the shaft (except both ends of the shaft), i.e., a base roller is obtained.

Next, 100 weight parts of "MR400" (manufactured by Nippon Polyurethane Industry Co., Ltd.) is solved in 900 weight parts of ethyl acetate, so that a surface treatment liquid is obtained. The base roller is immersed in the surface treatment liquid while the temperature of the surface treatment liquid is kept at 20° C. Next, the base roller is heated for 10 hours using an oven kept at 100° C. Thereafter, the base roller is cooled, and polished (by means of rough polishing, finishing polishing or the like) under different conditions, so that developing rollers α, β, γ, ϵ, ζ and η are formed. Manufacturing conditions and properties of the developing rollers α, β, γ, ϵ, ζ and η are shown in FIG. 4.

To be more specific, the developing roller α having a surface roughness Rz of 7.1 μm is obtained by performing polishing by one time using abrasive compound whose grain size is 30 μm. The developing roller β having a surface roughness Rz of 8.3 μm is obtained by performing polishing by one time using abrasive compound whose grain size is 40 μm. The developing roller γ having a surface roughness Rz of 11.1 μm is obtained by performing polishing by two times using abrasive compound whose grain size is 40 μm. The developing roller ϵ having a surface roughness Rz of 15.0 μm is obtained by performing polishing by three times using abrasive compound whose grain size is 40 μm.

The developing roller ζ having a surface roughness Rz of 5.0 μm is obtained by performing polishing by one time using abrasive compound whose grain size is 20 μm. The developing roller η having a surface roughness Rz of 17.2 μm is obtained by performing polishing by three times using abrasive compound whose grain size is 40 μm.

The surface roughness Rz of the respective developing rollers α, β, γ, ϵ, ζ and η are measured using, for example, ten-point mean roughness measurement (JIS B0601:2001). The ten-point mean roughness is obtained by determining a difference between the average value of five highest points and the average value of five lowest points, among ten equally-spaced points along the circumference of the developing roller 4. This measurement is performed using a surface roughness measuring system "ZSM 200" manufactured by Kosaka Laboratory Ltd.

In the first embodiment (FIG. 1), the image forming apparatus such as a printer in which the circumferential speed of the developing roller 4 is 161.5 mm/s is referred to as a machine M1. The image forming apparatus in which the circumferential speed of the developing roller 4 is 189.2 mm/s is referred to as a machine M2. The circumferential speed of the developing roller 4 is calculated based on the printing speed (i.e., a circumferential speed of the photosensitive drum 7, or the passage speed of the recording medium 11). In the machine M1, the outer diameter of the developing roller 4 is 18.39 mm, the circumferential speed of the photosensitive drum 7 is 131.7 mm/s, and the outer diameter of the photosensitive drum 7 is 30 mm. In the machine M2, the outer diameter of the developing roller 4 is 17.62 mm, the circumferential speed of the photosensitive drum 7 is 162.0 mm/s, and the outer diameter of the photosensitive drum is 30 mm. The ratio of the circumferential speed of the developing roller 4 to the circumferential speed of the photosensitive drum 7 is referred to as a circumferential speed ratio. The circumferential speed ratio in the machine M1 is 1.226, and the circumferential speed ratio in the machine M2 is 1.168. The above described values of the machines M1 and M2 are shown in FIG. 6.

In this regard, if the circumferential speed of the developing roller 4 is slower than 161.5 mm/s, the printing speed becomes slow. For this reason, printing tests are not performed in the case where the circumferential speed of the developing roller 4 is slower than 161.5 mm/s.

Further, if the circumferential speed of the developing roller 4 is faster than 189.2 mm/s, the friction heat increases, and the load applied to the toner due to the friction heat increases, so that fusion bonding or breaking of toner may occur. For this reason, printing tests are not performed in the case where the circumferential speed of the developing roller 4 is faster than 189.2 mm/s.

In the machine M1, the printing of 1000 sheets (i.e., 1000 recording media 11) corresponds to 4700 rotations of the photosensitive drum 7, and corresponds to 9400 rotations of the developing roller 4. In the machine M2, the printing of 1000 sheets corresponds to 4000 rotations of the photosensitive drum 7, and corresponds to 8000 rotations of the developing roller 4.

Using the above described toners A, B, C, D and E, the developing rollers α, β, γ, ϵ, ζ and η and the machines M1 and M2, continuous printing tests are performed on Examples 1 through 24 and Comparative Examples 1 through 14 as shown in FIGS. 6, 7 and 8 as follows:

Example 1 uses the toner A, the developing roller α and the machine M1.

Example 2 uses the toner B, the developing roller α and the machine M1.

Example 3 uses the toner C, the developing roller α and the machine M1.

Example 4 uses the toner A, the developing roller α and the machine M2.

Example 5 uses the toner B, the developing roller α and the machine M2.

Example 6 uses the toner C, the developing roller α and the machine M2.

Example 7 uses the toner A, the developing roller β and the machine M1.

Example 8 uses the toner B, the developing roller β and the machine M1.

Example 9 uses the toner C, the developing roller β and the machine M1.

Example 10 uses the toner A, the developing roller β and the machine M2.

Example 11 uses the toner B, the developing roller β and the machine M2.

Example 12 uses the toner C, the developing roller β and the machine M2.

Example 13 uses the toner A, the developing roller γ and the machine M1.

Example 14 uses the toner B, the developing roller γ and the machine M1.

Example 15 uses the toner C, the developing roller γ and the machine M1.

Example 16 uses the toner A, the developing roller γ and the machine M2.

Example 17 uses the toner B, the developing roller γ and the machine M2.

Example 18 uses the toner C, the developing roller γ and the machine M2.

Example 19 uses the toner A, the developing roller ϵ and the machine M1.

Example 20 uses the toner B, the developing roller ϵ and the machine M1.

Example 21 uses the toner C, the developing roller ϵ and the machine M1.

Example 22 uses the toner A, the developing roller ϵ and the machine M2.

Example 23 uses the toner B, the developing roller ϵ and the machine M2.

Example 24 uses the toner C, the developing roller ϵ and the machine M2.

Comparative Example 1 uses the toner A, the developing roller ζ and the machine M1.

Comparative Example 2 uses the toner B, the developing roller ζ and the machine M1.

Comparative Example 3 uses the toner C, the developing roller ζ and the machine M1.

Comparative Example 4 uses the toner D, the developing roller ζ and the machine M1.

Comparative Example 5 uses the toner D, the developing roller η and the machine M1.

Comparative Example 6 uses the toner D, the developing roller ζ and the machine M2.

Comparative Example 7 uses the toner D, the developing roller η and the machine M2.

Comparative Example 8 uses the toner A, the developing roller η and the machine M1.

Comparative Example 9 uses the toner B, the developing roller η and the machine M1.

Comparative Example 10 uses the toner C, the developing roller η and the machine M1.

Comparative Example 11 uses the toner E, the developing roller ζ and the machine M1.

Comparative Example 12 uses the toner E, the developing roller η and the machine M1.

Comparative Example 13 uses the toner E, the developing roller ζ and the machine M2.

Comparative Example 14 uses the toner E, the developing roller η and the machine M2.

Next the operation of the developing device will be described.

When the developing device shown in FIG. 2 receives printing command, a motor provided in the main body of the image forming apparatus (a printer) starts to rotate. The rotation of the motor is transmitted to the drum gear via several intermediate gears provided in the main body, and the photosensitive drum 7 rotates. The rotation of the drum gear is transmitted to the developing roller gear, and the developing roller 4 rotates. The rotation of the developing roller gear is transmitted to the sponge roller gear via the idle gear, and the sponge roller 3 rotates. The rotation of the drum gear is further transmitted respectively to the charge roller gear, the cleaning roller gear and the transfer roller gear, so that the charge roller 9, the cleaning roller 10 and the transfer roller 8 respectively rotate. The rotation of the motor provided in the main body is transmitted to the heat roller gear via other several gears, and the heat roller 12 rotates. The backup roller 13 rotates following the rotation of the heat roller 12. The rotating directions of the respective rollers and the photosensitive drum 7 are illustrated by arrows shown in FIG. 2.

At the same time as the motor starts rotating, the respective rollers (for the developing and transferring) and the halogen lamp (for the fixing) are respectively applied with predetermined bias voltages by a not shown power source provided in the main body of the image forming apparatus (printer). The charge roller 9 (applied with the voltage) rotates to uniformly charges the surface of the photosensitive drum 7. When the charged part of the photosensitive drum 7 reaches the position facing the LED head 6, the LED 6 exposes the surface of the photosensitive drum 7 according to image information sent from the controller (not shown), and forms a latent image on the surface of the photosensitive drum 7. When the latent image on the photosensitive drum 7 reaches a position facing the developing roller 4, the toner (in the form of a thin layer) on the surface of the developing roller 4 adheres to the surface of the photosensitive drum 7 due to the difference in electric potential between the latent image on the photosensitive drum 7 and the developing roller 4.

The toner image formed on the photosensitive drum 7 is transferred to the recording medium 11 due to the difference in electric potential between the photosensitive drum 7 and the transfer roller 8. The toner image having been transferred to the recording medium 11 due to the heat of the heat roller 12 (heated by the halogen lamp) and the pressure between the heat roller 12 and the backup roller 13. A part of the toner remaining on the surface of the photosensitive drum 7 is scraped off from the surface of the photosensitive drum 7, and is recovered by the developing device according to a sequence determined by the controller (not shown).

With the image forming apparatus using the developing device that performs the above described operation, continuous printing tests are performed as follows.

In the continuous printing tests, a sheet of A4 standard size (having a length of 297 mm and a width of 210 mm) having a basis weight of 64 g/m$^2$ is used as the recording medium 11. The sheet is fed in a traverse feeding manner (so that two longer sides of the sheet become a leading end and a trailing end), and a solid image (of black) is printed on the sheet. The density (the optical density) of the solid image is measured by a spectrophotometer "X-Rite" (manufactured by X-Rite Inc.), and is in the range from 1.20 to 1.40. Then, an image of 25% duty (i.e., an image including an area of black image of 25% with respect the solid image) is printed on 10000 sheets. Further, at every 1000 sheets printed with 25% duty image, a solid image is printed on a sheet, and the printed image is observed. The continuous printing test is performed on a normal temperature (from 24 to 26° C.) and normal humidity (from 40 to 60%), i.e., under NN environment. In this checking, the toner on the surface of the developing roller 4 is observed with naked eyes, and layer undulation is evaluated according to evaluation criteria described later. The evaluation results are shown in FIGS. 6, 7 and 8.

In FIGS. 6, 7 and 8, "O" indicates that no layer undulation is observed. Further, "X" indicates that layer undulation is observed so as to affect the image.

Further, an abrasion of the developing roller 4 also causes deterioration of image quality. If the abrasion of the developing roller 4 occurs, concaves and convexes on the surface of the developing roller 4 are reduced. In such a case, the toner is not sufficiently held on the surface of the developing roller 4, and the toner layer is not sufficiently formed on the surface of the developing roller 4. As a result, the surface of the sheet (the recording medium 11) is not supplied with sufficient toner, and therefore density of solid image on the sheet decreases. In this example, low density portion appears on areas of approximately 50 mm from both ends of the sheet. For this reason, in the continuous printing tests, the difference in density between the center portion and the end portion of the solid image (printed once at every 1000 sheets) is measured and evaluated. The evaluation results are shown by O, Δ and X in FIGS. 6, 7 and 8.

"O" indicates that the absolute value of the difference in density between the center portion and the end portion of the solid image is less than 0.15.

"Δ" indicates that the absolute value of the difference in density between the center portion and the end portion of the solid image is greater than 0.15, but less than 0.45.

"X" indicates that the absolute value of the difference in density between the center portion and the end portion of the solid image is greater than 0.45.

Furthermore, in the continuous printing tests, the occurrence of image blurring is checked with naked eyes and evaluated. The evaluation results are shown by ○, Δ and X in FIGS. 6, 7 and 8.

"O" indicates that no image blurring is observed.

"Δ" indicates that image blurring is observed in an area within 50 mm from the trailing end of the image.

"X" indicates that image blurring is observed in an area of more than 50 mm from the trailing end of the image.

In this regard, the image blurring is caused when the toner is not sufficiently supplied by the sponge roller 3 to the developing roller 4 due to the lack of fluidity or low charging properties of the toner. If the image blurring occurs, an excellent image is not formed.

Moreover, when the toner is excessively charged, excessive amount of toner adheres to the developing roller 4 and is transferred to the sheet via the photosensitive drum 7. In such a case, more than defined amount of toner adheres to the sheet, and therefore image may be smeared. This phenomenon is herein referred to as smear. The smear is most distinguishable in a half-tone image, and therefore a half tone image of 25% duty (described above) is observed with naked eyes. The smear is more likely to appear at the center portion of the image. The evaluation results are shown by O and X in FIGS. 6, 7 and 8.

"O" indicates that the half tone image is formed to have entirely uniform density.

"X" indicates that the half tone image has uneven dense portions (i.e., smear) at the center portion thereof.

Further, a phenomenon called "fog" is likely to occur when the amount of reverse-charged toner increases. The fog is a phenomenon where the toner adheres to a portion which is to be a non-printed portion (i.e., a white portion), and exhibits faint color. For this reason, when the solid image is printed at every 1000 sheets as described above, a white image is also printed, and is checked to evaluate the level of fog.

To be more specific, a color difference ΔY between a white sheet (having density of 0%) before printing and a printed white image is determined based on the following equation (4) using a spectrophotometer "CM2600d" (manufactured by Minolta Co., Ltd.) having a measurement diameter of 8 mm:

$$\Delta Y=\sqrt{(L_1-L_2)^2+(a_1-a_2)^2+(b_1-b_2)^2} \quad (4)$$

where $L_1$, $a_1$ and $b_1$ indicate chromaticity (expressed in CIE-lab color system) of the surface of the sheet after the white image is printed on the white sheet. $L_2$, $a_2$ and $b_2$ indicate chromaticity of the white sheet before printing.

The above described color difference ΔY is measured 5 times at the same position, and the average ΔY* thereof is determined. The fog is evaluated based on the value of ΔY*. If the value of ΔY* is large, it indicates that a fog is noticeable. It is preferable that the value of ΔY* is less than or equal to 4 (i.e., ΔY*≦4). It is more preferable that the value of ΔY* is less than or equal to 2 (i.e., ΔY*≦2). The evaluation results are shown by O and X in FIGS. 6, 7 and 8.

"O" indicates that the fog is not noticeable, and ΔY*≦2 is satisfied during the continuous printing test on 10000 sheets.

"Δ" indicates that the fog is slightly noticeable, and ΔY*≦4 is satisfied during the continuous printing test on 10000 sheets.

"X" indicates that the fog is very noticeable, and the value of ΔY* exceeds 4 (ΔY*>4) in the continuous printing test.

In Examples 1 through 24, images can be formed without causing the layer undulation, the image blurring, the abrasion of the developing roller, the smear and the fog.

In contrast, in Comparative Example 1, the layer undulation occurs when the printing is performed on 6000 sheets, and the image blurring occurs when the printing is performed on 8000 sheets.

In Comparative Example 2, the value of ΔY* is 3.5 when the printing is performed on 8000 sheets.

In Comparative Example 3, the value of ΔY* is 3.9 when the printing is performed on 6000 sheets.

In Comparative Example 4, the layer undulation occurs when the printing is performed on 2000 sheets.

In Comparative Example 5, the smear occurs when the printing is performed on 4000 sheets.

In Comparative Example 6, the layer undulation and image blurring occur when the printing is performed on 2000 sheets.

In Comparative Example 7, the smear occurs when the printing is performed on 8000 sheets.

In Comparative Example 8, the smear occurs and the value of ΔY* is 2.9 when the printing is performed on 8000 sheets.

In Comparative Example 9, the smear occurs when the printing is performed on 6000 sheets, and the abrasion of the developing roller occurs when the printing is performed on 8000 sheets.

In Comparative Example 10, the abrasion of the developing roller occurs and the value of ΔY* is 3.7 when the printing is performed on 6000 sheets.

In Comparative Example 11, the smear occurs when the printing is performed on 4000 sheets.

In Comparative Example 12, the abrasion of the developing roller occurs and the value of ΔY* is 2.8 when the printing is performed on 4000 sheets.

In Comparative Example 13, the layer undulation occurs when the printing is performed on 4000 sheets, the smear occurs and the value of ΔY* is 3.8 when the printing is performed on 6000 sheets.

In Comparative Example 14, the abrasion of the developing roller occurs and the value of ΔY* is 3.8 when the printing is performed on 8000 sheets.

Figure 9:
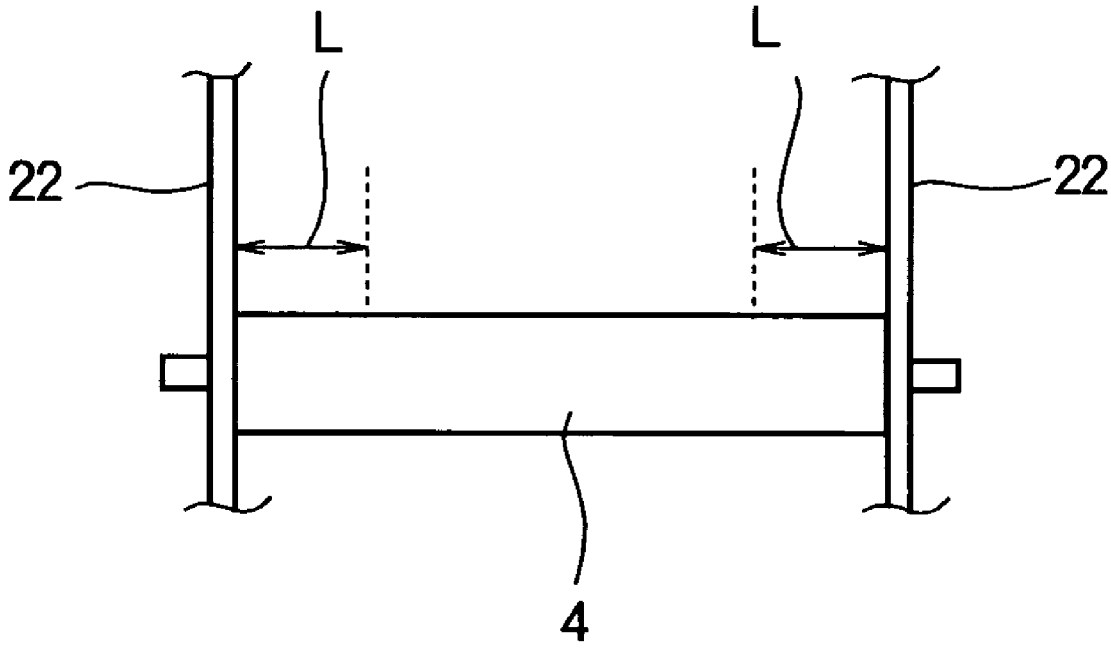
FIG. 9 shows a relationship between a developing roller and a casing of a developing device.

To be more specific, in Comparative Example 9, the abrasion of the developing roller 4 occurs in areas within 50 mm from both ends of the developing roller 4. When the continuous printing test is further continued, the density is reduced at end portions of the sheet (i.e., areas within 30 mm from the ends of the sheet). When the continuous printing test is further continued, the end portions of the sheet become almost white. In this regard, using SEM (Scanning Electron Microscope) "S-2380N" manufactured by Hitachi Ltd., the toner existing in the vicinity of the developing roller 4 (more specifically, 5 mm from the outer surface of developing roller 4) and in the end portion of the developing device 101 (more specifically, 15 mm inside from the side wall of the housing 22 of the developing device 101 shown in FIG. 9 in the axial direction of the developing roller 4) is observed at 10000 times magnification. As a result, a lot of agglomerates of the toner having the size of approximately 20 μm are observed. Further, when the printing test is continued up to 10000 sheets, and then the surface of the developing roller 4 is observed using the SEM, little concaves or convexes are found on the surface of the developing roller 4. Therefore, it is understood that the surface of the developing roller 4 is abraded. When the surface roughness of the developing roller 4 is measured using ten-point mean roughness measurement, the surface roughness of the developing roller 4 (after the continuous printing test) is 2 μm.

The same phenomena are also found in Comparative Examples 12 and 14.

In Comparative Examples 9 and 10, the density is reduced at the end portions of the sheet (i.e., areas within 30 mm from both ends of the sheet) in the width direction.

From the results shown in FIGS. 6, 7 and 8, it is understood that the abrasion of the developing roller is likely to occur (Comparative Examples 12 and 14) when the liberation ratio of $SiO_2$ and the liberation ratio of $TiO_2$ are high (i.e., the liberation amount T of the external additives is large). In contrast, the layer undulation is likely to occur (Comparative Examples 1, 4 and 6) when the liberation ratio of $SiO_2$ and the liberation ratio of $TiO_2$ are low (i.e., the liberation amount T of the external additives is small). Further, the image blurring is likely to occur (Comparative Examples 9, 10, 12 and 14) when the surface roughness Rz (mm) of the developing roller 4 is low.

These results show that, when the amount of the external additives liberated from the mother particles is large, the layer undulation occurs, which causes the abrasion of the developing roller. However, on condition that the circumferential speed of the developing roller 4 is high, there are cases where it is suitable that the liberation ratio of the external additives is high. Therefore, there must be an optimum relationship between adhesive force of the external additives of the toner (with respect to the mother particles), the surface roughness of the developing roller 4 and the circumferential speed of the developing roller 4. For this purpose, a value of the following expression (5) is calculated based on the liberation amount of the external additives of the toner, the surface roughness of the developing roller 4 and the circumferential speed of the developing roller 4, using the data of Examples 1 through 24 and Comparative Examples 1 through 14:

$$T \cdot Rz/Vd \quad (5)$$

In the expression (5), "T" indicates the liberation amount of the external additives (weight parts).

"Rz" indicates the surface roughness of the developing roller 4 (m).

"Vd" indicates the circumferential speed of the developing roller 4 (mm/s).

The results of calculation of T·Rz/Vd are shown in FIGS. 6, 7 and 8.

Based on the values of T·Rz/Vd and the evaluation results shown in FIGS. 6, 7 and 8, it is understood that, when the value of T·Rz/Vd is greater than or equal to $4.98\times10^{-6}$ and less than or equal to $1.99\times10^{-5}$ (i.e., when the above described inequality (1) is satisfied), an excellent image can be obtained without causing the layer undulation, the image blurring or the abrasion of the developing roller.

In the case where the external additives contain hydrophobic silica fine particles and metal oxide fine particles, in order to satisfy the inequality (1), it is preferable that:

the adding amount (Ps) of the hydrophobic silica fine particles is 0.8 weight parts, the liberation ratio (Ys) of the hydrophobic silica fine particles is from 4.7% to 9.4%, and the adding amount (Pt) of the metal oxide fine particles is 1.0 weight part, and the liberation ratio (Yt) of the metal oxide fine particles is from 9.5% to 13.9%.

Further, it is preferable that the surface roughness (Rz) of the developing roller is from 7.1 μm to 15.0 μm, and the circumferential speed of the developing roller is from 161.5 mm/s to 189.2 mm/s.

Second Embodiment

Using Examples 1 through 24 (with which excellent image can be obtained in the first embodiment), continuous printing tests are similarly performed under "LL" environment of low temperature (22° C.) and low humidity (30%) and under "HH" environment of high temperature (28° C.) and high humidity (80%).

Generally, under the LL environment, the toner is likely to be charged and the smear is likely to occur. Under the HH environment, it is difficult for the toner to be uniformly charged, and the fog is likely to occur. The printing tests of the second embodiment are intended to check the performances under such adverse environments.

The results of the printing tests on Examples 1 through 24 under the LL and HH environments are excellent in all items as is the case with the results shown in FIGS. 6 and 7. To be more specific, in the printing tests on Examples 1 through 24, excellent solid image and excellent halftone image can be continuously obtained up to 10000 sheets, without causing the layer undulation, the image blurring, the smear or the fog.

Next, a description will be made to a nip width.

In the developing device of FIG. 2, the developing roller 4 and the sponge roller 3 are adjusted so that the nip width N therebetween is 1.00 mm as was described in the first embodiment. When the nip width N is narrower, the time by which the developing roller 4 and the sponge roller 3 contact each other becomes short, and therefore it becomes difficult for the toner be charged, with the result that the fog is likely to occur. In contrast, when the nip width N is wider, the time by which the developing roller 4 and the sponge roller 3 contact each other becomes long, and therefore the toner is easily charged, with the result that the smear is likely to occur. Therefore, the nip width N between the developing roller 4 and the sponge roller 3 is varied as 0.60 mm, 0.80 mm, 1.20 mm and 1.40 mm so as to determine a nip width with which the inequality (1) is enabled.

Example 2-1

The developing roller 4 and the sponge roller 3 are adjusted so that the nip width N is 0.8 mm, and continuous printing tests are similarly performed on Examples 1 through 24 described in the first embodiment under the LL, NN and HH environments. The results of the printing tests on Examples 1 through 24 under the LL, NN and HH environments are excellent in all items as is the case with the results shown in FIGS. 6 and 7. To be more specific, in Examples 1 through 24, excellent solid image and excellent halftone image can be continuously obtained up to 10000 sheets, without causing the layer undulation, the image blurring, the abrasion of the developing roller and the smear, and the value of ΔY* (fog) is less than or equal to 2 (ΔY*≦2).

Example 2-2

The developing roller 4 and the sponge roller 3 are adjusted so that the nip width N is 1.2 mm, and continuous printing tests are similarly performed on Examples 1 through 24 described in the first embodiment under the LL, NN and HH environments. The results of the printing tests on Examples 1 through 24 under the LL, NN and HH environments are excellent in all items as is the case with the results shown in FIGS. 6 and 7. To be more specific, in Examples 1 through 24, excellent solid image and excellent halftone image can be continuously obtained up to 10000 sheets, without causing the layer undulation, the image blurring, the abrasion of the developing roller and the smear, and the value of ΔY* (fog) is less than or equal to 2 (ΔY*≦2).

Comparative Example 2-1

The developing roller 4 and the sponge roller 3 are adjusted so that the nip width N is 0.6 mm, and continuous printing tests are similarly performed on Examples 1 through 24 described in the first embodiment under the LL and HH environments. Excellent results ("O") are obtained in all items under the LL environment. The evaluation results of the printing tests on Examples 1 through 24 under the HH environment (referred to as Comparative Examples 2-1-1 through 2-1-24) are shown in FIGS. 10 and 11. In Comparative Example 2-1-1, the value of ΔY* is 3.2 (ΔY*=3.2) when the printing is performed on 4000 sheets. In Comparative Example 2-1-4, the value of ΔY* is 6.8 (ΔY*=6.8) when the printing is performed on 8000 sheets. In Comparative Example 2-1-10, the value of ΔY* is 3.4 (ΔY*=3.4) when the printing is performed on 3000 sheets. When the charge distribution of the toner on the surface of the developing roller 4 is measured using "E-Spart Analyzer" (manufactured by Hosokawa Micron Corp.), a larger amount of reverse-charged toner (larger than usual) is detected.

Comparative Example 2-2

The developing roller 4 and the sponge roller 3 are adjusted so that the nip width N is 1.4 mm, and continuous printing tests are similarly performed on Examples 1 through 24 described in the first embodiment under the LL and HH environments. Excellent results ("O") are obtained in all items under the HH environment. The evaluation results of the printing tests on Examples 1 through 24 under the LL environment (referred to as Examples 2-2-1 through 2-2-24) are shown in FIGS. 12 and 13. In Comparative Example 2-2-19, the smear occurs when the printing is performed on 8000 sheets. In Comparative Example 2-2-20, the smear occurs when the printing is performed on 6000 sheets. In Comparative Example 2-2-22, the smear occurs when the printing is performed on 4000 sheets. When the toner on the surface of the developing roller 4 is observed using the SEM, very little external additives are observed on the surface of the toner. It is understood that the large nip N causes the friction of the toner (in the vicinity of the nip) to increase, so that the external additives on the surface of the toner are dropped from or buried in the toner (the mother particles).

As described above, according to the second embodiment, an excellent image can be obtained under the LL, NN and HH environments, without causing the layer undulation, the image blurring and the abrasion of the developing roller 4, when the inequality (1) is satisfied. Moreover, by setting the nip width N between the developing roller 4 and the sponge roller 3 in the range from 0.8 mm to 1.2 mm, an excellent image can be obtained under the LL, NN and HH environments, without causing the image blurring, the layer undulation, the abrasion of the developing roller 4 and the smear, and the value of $\Delta Y^*$ (fog) can be restricted to be less than or equal to 2 ($\Delta Y^* \leqq 2$).

In the above described first and second embodiments, the developing device according to the present invention is applied to a printer. However, the developing device according to the present invention is also applicable to other image forming apparatus using electrophotography such as a facsimile machine, a copier or the like.

Further, constituent materials of the toner and the developing roller 4 are not limited to those described in the first and second embodiments.

The resin used in the toner in the present invention is, for example, thermoplastic resin such as vinyl resin, polyamide resin, polyester resin or the like. A monomer constituting the vinyl resin of the above described thermoplastic resin is, for example, styrene or styrene derivative (such as styrene, 2,4-dimethyl styrene, α-methyl styrene, p-ethyl styrene, o-methyl styrene, m-methyl styrene, p-methyl styrene, p-chlorostyrene, vinyl naphthalene or the like), ethylenic monocarboxylic acid and ester thereof (such as 2-ethylhexyl acrylate, methyl methacrylate, acrylic acid, methyl acrylate, ethyl acrylate, n-propyl acrylate, isobutyl acrylate, t-butyl acrylate, amyl acrylate, cyclohexyl acrylate, n-octyl acrylate, isooctyl acrylate, decyl acryl, lauryl acrylate, stearyl acrylate, methoxyethyl acrylate, 2-hydroxyethyl acrylate, glycidyl acrylate, phenyl acrylate, methyl-α-chroloacrylate, methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, diethylaminoethyl methacrylate or the like), ethylenically unsaturated monoolefin compound (such as ethylene, propylene, butylenes, isobutylene or the like), vinyl ester compound (such as vinyl chloride, vinyl acetate, vinyl propion, vinyl formate, and vinyl caproate), ethylenic carboxylic acid derivative (such as acrylonitrile, methacrylonitrile, acrylamide or the like), ethylenic carboxylic acid and its derivative (such as ester maleate or the like), vinyl ketone compound (such as vinyl methyl ketone or the like), vinyl ether (such as vinyl methyl ether or the like) or the like.

Further, as a cross-linking agent of the toner, it is possible to use general cross-linking agent such as divinylbenzene, divinyl naphthalene, polyethyleneglycol-dimethacrylate, 2,2'-bis(4-methacryloxy-diethoxy-phenyl)propane, 2,2'-bis(4-acryloxy-diethoxy-phenyl)propane, diethylene glycol diacrylate, triethylene glycol diacrylate, triethylene glycol diacrylate, 3-butylene glycol dimethacrylate, 1,6-hexylene glycol dimethacrylate, neopentyl glycol dimethacrylate, dipropylene glycol dimethacrylate, polypropylene glycol dimethacrylate, trimethylolpropane trimethacrylate, trimethylolpropane triacrylate, tetramethylolpropane tetraacrylate or the like. Furthermore, it is also possible to combine two or more of the above described cross-linking agents.

Further, as inorganic fine particles, it is possible to use, for example, metal oxide (including zinc, aluminum, cerium, cobalt, iron, zirconium, chrome, manganese, strontium, tin, antimony or the like), combined metal oxide (such as calcium titanate, magnesium titanate and strontium titanate or the like), metal salt (such as barium sulfate, calcium carbonate, magnesium carbonate, aluminum carbonate or the like), clay mineral (such as kaolin or the like), phosphate compound (such as apatite or the like), silicide (such as silica, silicon carbide, silicon nitride), carbon power (such as carbon black, graphite or the like) or the like.

In the above description, the toner containing two kinds of external additives, i.e., one kind of silica and one kind of titanium oxide (titania) has been described. However, it is also possible that the toner contains only one kind of external additives, or that the toner contains three or more kinds of external additives.

Further, although the developing roller has been described to be made using polyol SF-8427, it is also possible to use other polyol together with the polyol SF-8247. In this case, it is possible to use, for example, polyester polyol, polyether polyol or the like. As the above described polyether polyol, it is possible to use, for example, polyethylene glycol, polypropylene glycol, polypropylene glycol-ethylene glycol, polyalkylene glycol (known as a blend of the polyethylene glycol or the like), polytetramethylene ether glycol, copolymerized polyol of tetrahydrofuran and alkylene oxide, modified body or blend of these materials, or the like.

As the above described polyester polyol, it is possible to use, for example, condensed polyester polyol obtained by condensation of dicarboxylic acid such as adipic acid and polyol such as ethylene glycol, lactone-based polyester polyol, polycarbonate polyester polyol, blend thereof, or the like.

As isocyanate, it is possible to use any kind of isocyanate conventionally used in manufacturing conventional polyurethane. For example, it is possible to use diphenylmethane isocyanate, toluene diisocyanate, naphthalene diisocyanate, tolidine diisocyanate, para-phenylene diisocyanate, isophorone diisocyanate, prepolymer or modified material thereof, blend thereof, or the like.

As auxiliary agent used to manufacture the developing roller (including a polyurethane layer), it is possible to use chain extender, cross-linking agent or the like. To be more specific, it is possible to use glycol compound, hexane triol, trimethyl propane, amine compound or the like.

While the preferred embodiments of the present invention have been illustrated in detail, it should be apparent that modifications and improvements may be made to the invention without departing from the spirit and scope of the invention as described in the following claims.

What is claimed is:

1. A developing device disposed facing an image bearing body that bears a latent image, said developing device including a developer bearing body that bears a developer for developing said latent image, said developer comprising mother particles and external additives, wherein a liberation amount T (weight parts) of said external additives liberated from said mother particles with respect to 100 weight parts of said mother particles, a surface roughness Rz (m) of said developer bearing body, and a circumferential speed Vd (mm/s) of said developer bearing body satisfy the following relationships:

$1.326\times10^{-1} \leqq T \leqq 2.142\times10^{-1}$ (weight parts), $7.1\times10^{-6} \leqq Rz \leqq 15.0\times10^{-6}$ (m), $161.5 \leqq Vd \leqq 189.2$ (mm/s), and $4.98\times10^{-6} \leqq (T\times Rz/Vd) \leqq 1.99\times10^{-5}$ (s).

2. The developing device according to claim 1, further comprising a developer layer forming member that forms a thin developer layer on a surface of said developer bearing body.

3. The developing device according to claim 1, wherein said external additives contain at least hydrophobic silica.

4. The developing device according to claim 1, wherein said external additives contain at least metal oxide.

5. The developing device according to claim 1, wherein said external additives contain at least hydrophobic silica and metal oxide, and when an adding amount (weight parts) of said hydrophobic silica with respect to 100 weight parts of said mother particles is expressed as Ps, a liberation ratio (%) of said hydrophobic silica is expressed as Ys, an adding amount (weight parts) of said metal oxide with respect to 100 weight parts of said mother particles is expressed as Pt, and a liberation ratio (%) of said metal oxide is expressed as Yt, said liberation amount T is expressed as:

$$T=(Ps\times Ys/100)+(Pt\times Yt/100).$$

6. The developing device according to claim 3, wherein said liberation amount of said hydrophobic silica with respect to 100 weight parts of said mother particles is greater than or equal to $0.376\times10^{-1}$ and less than or equal to $0.752\times10^{-1}$.

7. The developing device according to claim 4, wherein said liberation amount of said metal oxide with respect to 100 weight parts of said mother particles is greater than or equal to $0.950\times10^{-1}$ and less than or equal to $1.390\times10^{-1}$.

8. The developing device according to claim 4, wherein said metal oxide is titanium oxide.

9. The developing device according to claim 1, wherein said developer bearing body is a developing roller.

10. The developing device according to claim 1, further comprising a developer supplying member contacting said developer bearing body, wherein a nip width between said developer bearing body and said developer supplying member is wider than or equal to 0.80 mm and narrower than or equal to 1.20 mm.

11. An image forming apparatus comprising:

said developing device according to claim 1.

* * * * *